United States Patent [19]

Sato

[11] 4,363,269

[45] Dec. 14, 1982

[54] INDEX WHEEL FOR PRINTING DEVICE

[75] Inventor: Yo Sato, Tokyo, Japan

[73] Assignee: Kabushiki Kaisha Sato, Japan

[21] Appl. No.: 248,691

[22] Filed: Mar. 30, 1981

[30] Foreign Application Priority Data

Apr. 2, 1980 [JP] Japan ..... 55-43200[U]

[51] Int. Cl.[3] ..... B41J 1/32

[52] U.S. Cl. ..... 101/110; 101/111

[58] Field of Search ..... 101/110, 30, 31, 368, 101/401, 401.1, 109, 111

[56] References Cited

U.S. PATENT DOCUMENTS

| | | | |
|---|---|---|---|
| 2,762,298 | 9/1956 | Knauer | 101/110 |
| 3,318,430 | 5/1967 | Boyd | 101/110 X |
| 3,560,289 | 2/1971 | Otto et al. | 101/401.1 |
| 3,768,619 | 10/1973 | Lewis | 101/401.1 |
| 3,828,664 | 8/1974 | Dikoff | 101/110 X |
| 3,927,613 | 12/1975 | Nantz | 101/110 |
| 4,018,157 | 4/1977 | Sato | 101/110 |
| 4,084,507 | 4/1978 | Sato | 101/110 |
| 4,155,302 | 5/1979 | Sato | 101/110 |
| 4,233,896 | 11/1980 | Hamisch, Jr. | 101/110 |
| 4,275,654 | 6/1981 | Hamisch, Jr. | 101/110 |

FOREIGN PATENT DOCUMENTS

| | | | |
|---|---|---|---|
| 2557876 | 7/1976 | Fed. Rep. of Germany | 101/110 |
| 453643 | 12/1949 | Italy | 101/110 |

*Primary Examiner*—E. H. Eickholt

*Attorney, Agent, or Firm*—Ostrolenk, Faber, Gerb & Soffen

[57] ABSTRACT

The disclosure concerns an index wheel for use in a printing device. The device includes a plurality of type wheels which are coaxially juxtaposed to one another in independently rotatable manner. The outer circumference of each type wheel carries a multiplicity of lands respectively bearing types. The outer circumference of the type wheel also has a multiplicity of engagement grooves, each formed between two adjacent lands. An index wheel of the invention is engageable with each type wheel to rotationally drive the type wheel when the index wheel is manually rotated through a selecting shaft by means of a selecting knob. The index wheel includes a ring-shaped body. A multiplicity of teeth are formed on the outer circumference of the ring-shaped body and are circumferentially spaced such that they engage with the engagement grooves of the respective type wheel. A multiplicity of index letters are respectively borne on the outer circumference of the ring-shaped body between any two adjacent teeth. According to the invention, the index letters are formed by a printing method, including a hot-stamping process.

15 Claims, 5 Drawing Figures

(A)

(B)

INDEX WHEEL FOR PRINTING DEVICE

BACKGROUND OF THE INVENTION

The present invention relates to a printing device, particularly for use with a portable label printing and applying machine (which is referred to as a "hand labeler"), and more particularly relates to improvements in an index wheel for the printing device.

Generally, these printing devices are either the type wheel type (see U.S. Pat. Nos. 4,055,118, 4,018,157 and 4,084,507) or the type band type (see U.S. Pat. Nos. 4,055,118 and 4,179,989). In the former type wheel type, a plurality of type wheels are coaxially juxtaposed to one another. Each index wheel is engageable with a corresponding type wheel to rotatively drive the type wheel when the index wheel is manually rotated through a selecting shaft by means of a selecting knob. The index wheels bear index letters or characters. The index wheels are usually molded of a plastic, and are molded as a whole unit, including the letters or characters. Numerous kinds of molds have to be prepared for index wheels which have different arrangements and combinations of the index letters. This raises production costs to a remarkably high level.

In view of this problem, there is another construction, in which the index letters are not molded but are instead printed on the outer circumference of an inner index wheel member and are covered with an outer index wheel member which is toothed on its outer circumference and is made of transparent plastic. Since the index letters have to be read out through the transparent outer index wheel member, they may be apparently distorted or doubled so that they frequently become hard to read. Moreover, when the outer index wheel member is to be fused to the outer circumference of the inner index wheel member, the printed index letters are thermally deformed or bubbles become confined in the outer index wheel member so that the index letters also are hard to read.

SUMMARY OF THE INVENTION

In view of the foregoing, it is an object of the present invention to provide an index wheel for use in a printing device, which index wheel is enabled to provide clearly readable index letters.

It is another object of the invention to reduce the production cost of an index wheel, particularly by forming index letters on the outer circumference of the index wheel by a printing process.

The present invention provides an index wheel for use in a printing device. The device includes a plurality of type wheels coaxially juxtaposed to one another in a rotatable manner. Each type wheel is formed on its outer circumference with a multiplicity of lands which bear respective types. A multiplicity of engagement grooves are defined in the outer circumference of the type wheel and each groove is formed between two adjacent lands.

An index wheel is made engageable with each of the type wheels to rotationally drive the latter. The index wheel comprises a ring-shaped body. A multiplicity of teeth are formed on the outer circumference of the ring-shaped body. Each tooth is circumferentially spaced from the two adjacent teeth, such that the teeth can engage with the engagement grooves of each of the respective type wheels. A multiplicity of index letters or other characters are respectively borne on the outer circumference of the ring-shaped body between adjacent teeth. The improvement resides in the index letters being formed by a printing process, including a hot-stamping process.

According to another feature of the present invention, the index wheel comprises a toothed wheel member having a multiplicity of teeth formed on its outer circumference and each tooth is circumferentially spaced from the two adjacent teeth such that the teeth can engage with the engagement grooves of the respective type wheels. A separate printed wheel member is provided. It includes a multiplicity of lands partially forming its outer circumference, and the lands are spaced by a circumferential distance equal to that of the root of each of the teeth of the toothed wheel member. A multiplicity of index letters or other characters are respectively borne on the lands. They are formed on the wheel members in a printing process, including a hot-stamping process. Retaining means retain the toothed wheel member and the printed wheel member is a side-by-side relationship for forming an integral structure of the index wheel. The retaining means orient the toothed wheel member and the printed wheel member such that the lands of the printed wheel member are fitted in the spaces between the teeth of the toothed wheel member.

BRIEF DESCRIPTION OF THE DRAWINGS

Other objects and features of the present invention will become apparent from the following description taken in conjunction with the accompanying drawings, in which.

DESCRIPTION OF THE PRIOR ART

Figure 1:
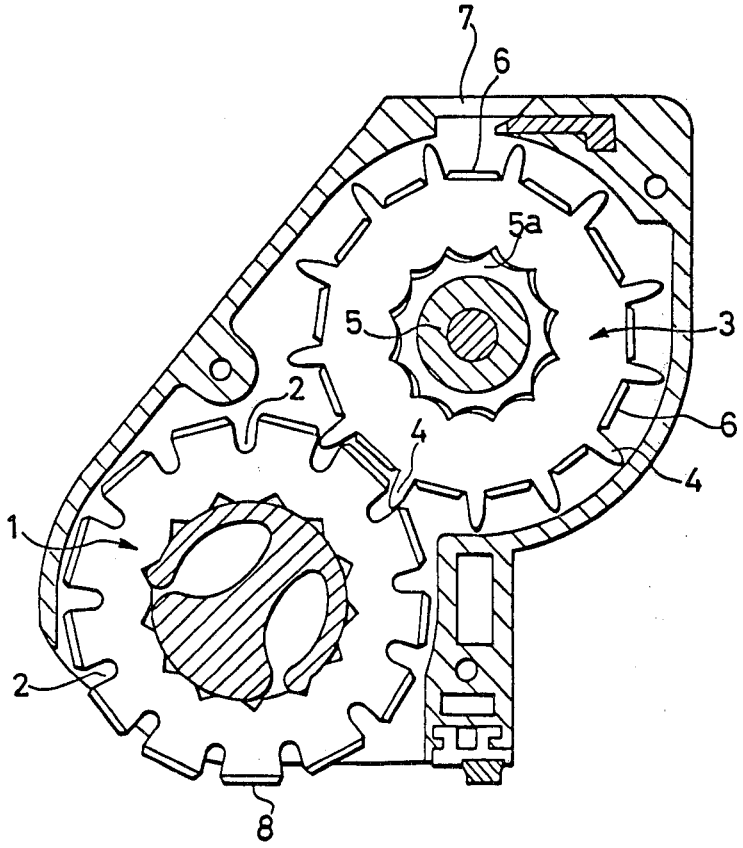
FIG.1 PRIOR ART
FIG. 1 is a longitudinal sectional view through a printing device which uses index wheels according to the prior art.
Figure 2:
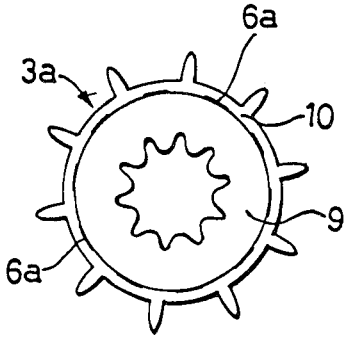
FIG.2 PRIOR ART
FIG. 2 is an elevational view showing another example of an index wheel according to the prior art.

With reference to FIGS. 1 and 2, a printing device using an index wheel according to the prior art is reviewed. In the first embodiment of a wheel type printing device, as shown in FIG. 1, a plurality of index wheels 3 are coaxially and rotatably juxtaposed. Each wheel 3 is formed on its outer circumference with a number of teeth 4 that can engage with the engagement grooves 2 of a respective one of a corresponding plurality of type wheels 1, which are also coaxially juxtaposed in a rotatable manner on a different axis from the index wheels. A desired index wheel 3 is selected and rotated by means of a selecting shaft 5, which has one end equipped with a selecting knob (not shown) and has the other end formed with a selecting gear wheel 5*a* for engaging the index wheel. The wheel 3 is rotated so that the desired index letter 6 is brought to a position just below a viewing aperture 7, which is formed at the upper surface of the printing device. The type wheel 1 meshing with the selected index wheel 3 is thereby rotated, so that a type 8 corresponding to the aforementioned selected index letter is brought into a preset printing position, facing downwardly, for instance.

In FIG. 2, the second embodiment of printed index wheel 3*a* includes a toothed outer index wheel member 10 of a molded transparent plastic which is fitted closely on the outer circumference of a printed inner index wheel member 9. The outer circumference of the wheel member 9 is printed in advance with index letters 6*a* by a suitable printing process.

DESCRIPTION OF A PREFERRED EMBODIMENT OF THE INVENTION

Figure 3:
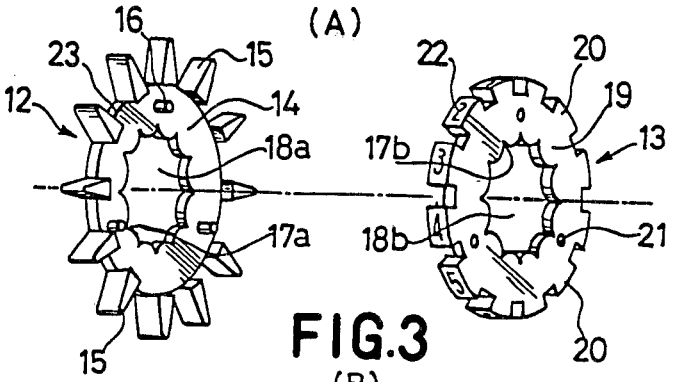
FIG. 3(A) is an exploded perspective view of an index wheel according to the present invention.
FIG. 3(B) is a longitudinal sectional view showing the index wheel of FIG. 3(A)
Figure 3:
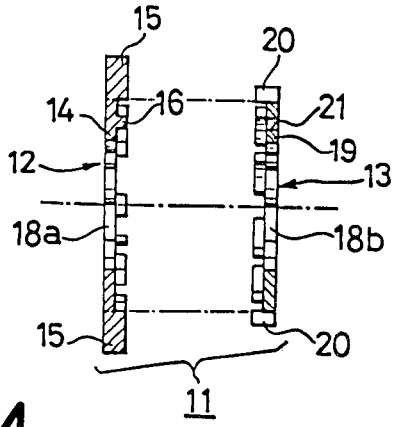

The present invention is now described with reference to FIGS. 3 and 4 which show one embodiment thereof. As seen in FIGS. 3(A) and (B), each index wheel 11 comprises a toothed wheel member 12 and a printed wheel member 13. Both of these are made of a synthetic resin, such as polycarbonate.

The toothed wheel member 12 comprises a ring-shaped body member 14 having a number of teeth 15 which are integrally formed on and equally circumferentially spaced around the outer circumference of the body member 14. The body member 14 is only one-half as thick (i.e., in axial width) as the teeth 15, and the member 14 is integrally molded on one of the side halves of the roots of the teeth 15. That side of the ring-shaped body member 14 which the teeth 15 extend past is the side of the member 14 that is to be brought into enagagement with the printed wheel member 13, and that side of the member 14 has three retaining pins 16 projecting from it. The center of the ring-shaped body member 14 is formed with a central hole 18*a*, and the whole circumference of that hole 18*a* is internally toothed at portion 17*a* to define a plurality of teeth that are engageable with the selecting gear wheel 5*a* (as shown in FIG. 1) of the selecting shaft 5.

The printed wheel member 13 is comprised of a ring-shaped body member 19, which has the same external and internal diameters as the ring-shaped body member 14. A plurality of display lands 20 are integrally formed at spaced intervals over the outer circumference of the ring-shaped body member 19 and they project from the exterior of the member 13. The display lands 20 have a common thickness (i.e., a common axial width) that is substantially equal to the thickness of the teeth 15 on the member 14, and they have a circumferential length substantially equal to that of spaces 23 which are defined between any two adjacent roots of the teeth 15 of the body member 14. The ring-shaped body member 19 is substantially one-half as thick as the display lands 20, and the member 19 is integrally molded on one of the side halves of the roots of the display lands 20. The ring-shaped body member 19 includes three retaining holes 21 in it, which are positioned to correspond to the retaining pins 16 of the body member 14. Moreover, the center of the ring-shaped body member 19 is formed with a central hole 18*b*, which corresponds in shape and dimension to the central hole 18*a*. The hole 18*b* has its whole circumference formed with an integrally toothed portion 17*b*, similarly to the central hole 18*a* of the ring-shaped body member 14, and the portion 17*b* includes a plurality of teeth made engageable with the selecting gear wheel 5*a* of the selecting shaft 5.

The outer surfaces of the respective display lands 20 are printed with index letters or characters 22, such as numerals or symbols, by a suitable printing process. One exemplary printing process is the hot-stamping process, in which heated types are pushed through a metal foil or a pigment onto the outer surfaces of the display lands 20.

Figure 4:
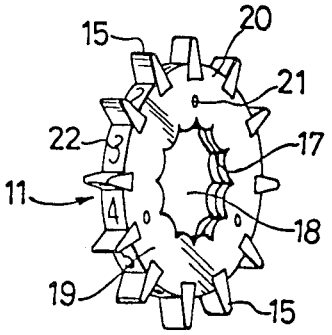
FIG. 4 is a perspective view showing the index wheel assembled into an integral structure.

The toothed wheel member 12 and the printed wheel member 13 are engaged and integrated with each other, as shown in FIG. 4, thus completing the index wheel 11. The retaining pins 16 of the toothed wheel member 12 are fitted in the respective retaining holes 21 of the printed wheel member 13 until the facing sides of the two body members 14 and 19 are brought into close contact with each other. The display lands 20 of the printed wheel member 13 then snugly fit in the spaces 23 between the teeth 15 of the toothed wheel member 12. If the wheel members 12 and 13 are heated and fused to each other, their integration can be made more complete.

As seen from FIG. 4, the completed index wheel 11 has its numerous teeth 15 protruding from all around its outer circumference, and the index letters 22 are displayed on the outer circumference between the teeth 15. The wheel 11 has one center hole 18 which is composed of the two aligned central holes 18*a* and 18*b* of the toothed wheel member 12 and the printed wheel member 13, and the center hole 18 has its circumference defined by an internally toothed portion 17 which is comprised of the aforementioned internally toothed portions 17*a* and 17*b*.

The present invention is not limited to the embodiment in which the index wheel 11 is made by assembling the toothed wheel member 12 and the printed wheel member 13. It can extend to all index rings that have their outer circumferences formed with index letters by a printing process, no matter what method is used to produce the index ring. For example, the present invention can be modified such that only the teeth are molded on an index wheel whose outer circumference has been printed in advance with index letters or such that after the index wheel has been molded as a whole, it is printed with index letters on its outer circumference between the respective teeth.

The index wheel of the printing device according to the present invention is formed all around its outer circumference with numerous teeth which can engage with the engagement grooves of a type wheel. The index wheel has index letters or characters on its outer circumference between those grooves. The letters or characters are formed by a printing process, including a hot-stamping process. As a result, in the index wheel according to the present invention, the index letters can be read out directly and clearly, enabling type selection to be performed accurately and promptly. Furthermore, production costs can be reduced because the index letters are formed not by a molding process but by a printing process.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An index wheel for a printing device, wherein the printing device comprises:

a type wheel; means mounting the type wheel for rotation about the axis thereof; the type wheel having a first outer circumference; a plurality of type bearing first lands defined on the first outer circumference of the type wheel; a plurality of grooves defined in the first outer circumference, with a groove being formed between adjacent ones of the first lands;

the printing device further comprising the index wheel; means mounting the index wheel for rotation about its axis, and the index wheel axis being different than the type wheel axis; the index wheel being engageable with the type wheel for rotationally driving the type wheel;

the index wheel comprising;

a toothed wheel member having a body with a second outer circumference; a plurality of teeth being defined on a second outer circumference, and the teeth being circumferentially spaced apart such that each tooth is engageable with a groove of the type wheel; each tooth extending out from a root at the second outer circumference;

a printed wheel member including a body and a plurality of second lands for defining a third outer circumference of the printed wheel member body; the second lands being circumferentially spaced by the distance of the roots of adjacent teeth on the tooth wheel member;

index characters borne on the second lands, the index characters being printed on the second lands; and retaining means for retaining the toothed wheel member and the printed wheel member in side-by-side relationship for defining the entire index wheel, and such that the second lands are fitted into the spaces between the teeth of the toothed wheel member.

2. The index wheel of claim 1, wherein the index characters have been printed by a hot stamping process.

3. A printing device comprising a plurality of the type wheels and a respective plurality of the index wheels of claim 2, wherein the grooves of each of the type wheels are engaged by the teeth of a respective one of the index wheels.

4. The index wheel of claim 3, wherein the teeth of the toothed wheel member are substantially twice as thick in the axial direction of the toothed wheel member as the body of the toothed wheel member and the teeth project beyond the body of the toothed wheel member toward the printed wheel member, so that the teeth project between the second lands.

5. The index wheel of claim 4, wherein the printed wheel member body has substantially the thickness of the toothed wheel member body.

6. The index wheel of either of claims 4 or 5, wherein the toothed wheel member body includes a central hole defined by an internally toothed circumference in the toothed wheel member; and the printed wheel member body also includes a central hole defined by an internally toothed circumference in the printed wheel member; and both of the central holes being co-extensive, thereby together to define a hole through the index wheel.

7. The index wheel of claim 1, wherein the retaining means comprises a retaining pin on the side of one of the printed wheel member and the toothed wheel member facing the other of them, and a retaining hole in the other of the printed wheel member and the toothed wheel member, and the retaining pin being received in the retaining hole.

8. The index wheel of claim 1, wherein the teeth of the toothed wheel member are thicker in the axial direction of the toothed wheel member than the body of the toothed wheel member and the teeth of the toothed wheel member project axially beyond the body of the toothed wheel member toward the printed wheel member, so that the teeth project between the second lands.

9. The index wheel of claim 8, wherein the teeth of the toothed wheel member are substantially twice as thick in the axial direction of the toothed wheel member than the toothed wheel member and the teeth project beyond the body of the toothed wheel member toward the printed wheel member a distance equal to the thickness in the axial direction of the toothed wheel member.

10. The index wheel of claim 9, wherein the printed wheel member body has substantially the thickness of the toothed wheel member body.

11. A printing device, comprising:

a plurality of type wheels and means juxtaposing the type wheels coaxially and mounting the type wheels for rotation around their axis;

each type wheel having a first outer circumference; a plurality of type bearing first lands being defined on the first outer circumference of the type wheel; a plurality of grooves being defined in the first outer circumference, with a groove being formed between adjacent ones of the first lands;

a corresponding number of index wheels and means juxtaposing the index wheels coaxially and mounting the index wheels for rotation around their axis; each of the index wheels including a toothed wheel member having a body with a second outer circumference; a plurality of teeth being defined on the second outer circumference, and the teeth being circumferentially spaced apart such that each tooth is engageable with a groove of the type wheel; each tooth extending out from a root at the second outer circumference;

a printed wheel member including a body and a plurality of second lands for defining a third outer circumference of the printed wheel member body; the second lands being circumferentially spaced by the distance of the roots of adjacent teeth on the toothed wheel member;

index characters borne on the second lands, the index characters being printed on the second lands; and retaining means for retaining the toothed wheel member and the printed wheel member in side-by-side relationship for defining the entire index wheel, and such that the second lands are fitted into the spaces between the teeth of the toothed wheel member.

12. The printing device of claim 11, wherein the index characters have been printed by a hot stamping process.

13. The printing device of claim 11, wherein each of the teeth of the toothed wheel members is thicker in the axial direction of the toothed wheel member than the body of the respective toothed wheel member and the teeth of the toothed wheel member project beyond the body of the toothed wheel member toward the respective printed wheel member, so that the teeth project between the second lands of the respective printed wheel member.

14. The printing device of claim 13, wherein the teeth of the toothed wheel members are substantially twice as thick in the axial direction of the toothed wheel member than the toothed wheel member and project beyond the body of the toothed wheel member toward the respective printed wheel member a distance equal to the thickness in the axial direction of the toothed wheel member.

15. The printing device of claim 14, wherein the printed wheel member body has substantially the thickness of the toothed wheel member body.

* * * * *